United States Patent [19]

Feller

[11] 4,432,267

[45] Feb. 21, 1984

[54] ADJUSTABLE NECK-BODY JOINT FOR GUITAR-LIKE INSTRUMENT

[76] Inventor: Terry L. Feller, 610 Lima Ave., Findlay, Ohio 45840

[21] Appl. No.: 373,031

[22] Filed: Apr. 29, 1982

[51] Int. Cl.[3] ..... G10D 1/08

[52] U.S. Cl. ..... 84/293; 84/291

[58] Field of Search ..... 84/293, 291, 292, 267

[56] References Cited

U.S. PATENT DOCUMENTS

| | | | |
|---|---|---|---|
| 2,793,556 | 5/1957 | Maccaferri | 84/293 X |
| 2,795,988 | 6/1957 | Maccaferri | 84/293 |
| 3,196,730 | 7/1965 | Daniel | 84/293 |
| 3,251,257 | 5/1966 | Bunker | 84/293 X |
| 3,910,151 | 10/1975 | Copeland | 84/291 X |
| 3,911,778 | 10/1975 | Martin | 84/293 X |
| 4,172,405 | 10/1979 | Kaman | 84/293 |

*Primary Examiner*—L. T. Hix
*Assistant Examiner*—Della Rutledge
*Attorney, Agent, or Firm*—Wilson, Fraser, Barker & Clemens

[57] ABSTRACT

An adjustable neck-body joint for a guitar-like instrument is disclosed. The instrument includes a main body portion and an elongated neck portion having at least two threaded apertures formed transversely therein near one end. The main body portion includes a recessed portion for receiving a mounting frame adapted to receive the one end of the neck portion. The frame includes respective apertures formed therein for generally aligning with the threaded apertures when the one end of the neck portion is received by the frame. Threaded fastener means extend through each of the frame apertures into cooperation with the threaded apertures for frictionally securing the neck portion to the frame. The threaded fasteners are smaller in diameter than the apertures formed in the frame such that, when the fasteners are loosened, the neck portion of the instrument can be adjusted relative to the frame. The frame is integrally secured to the main body portion of the instrument by a plurality of threaded fasteners.

10 Claims, 7 Drawing Figures

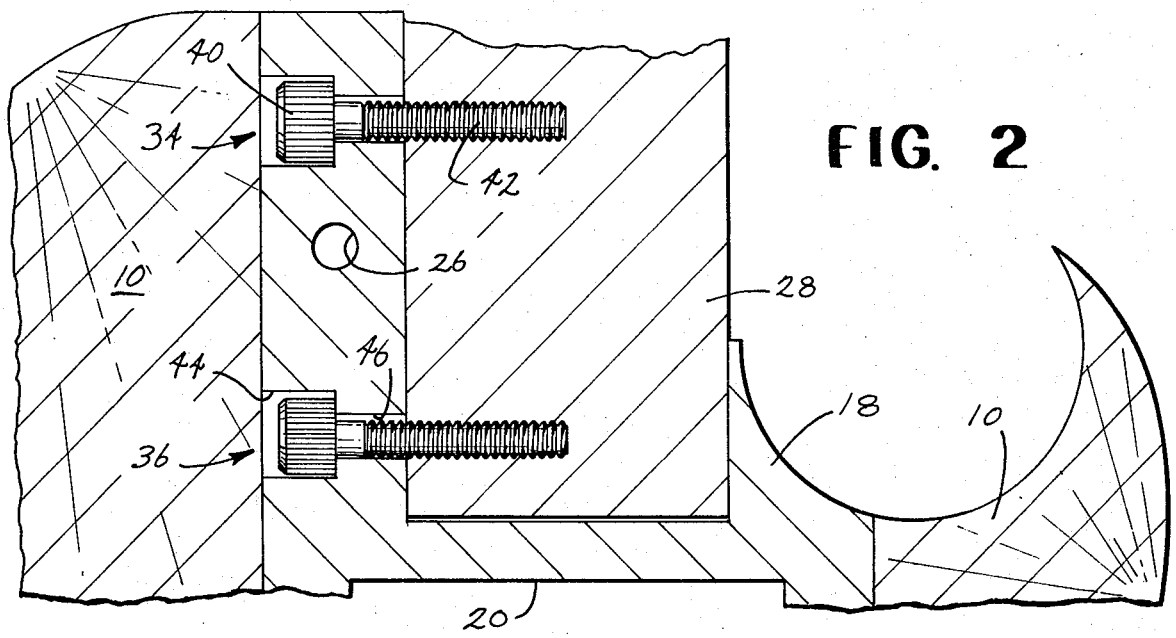
FIG. 2
FIG. 3A
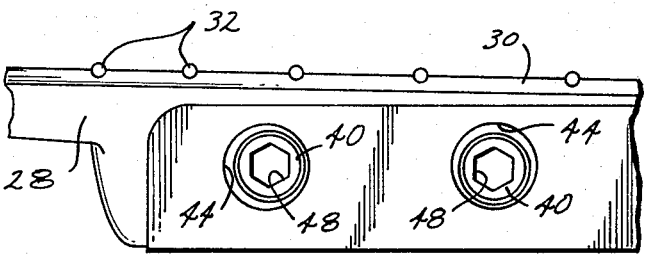
FIG. 3B
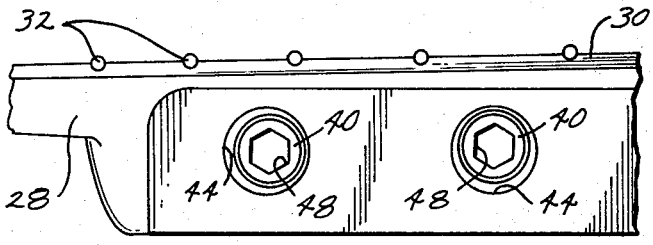
FIG. 3C
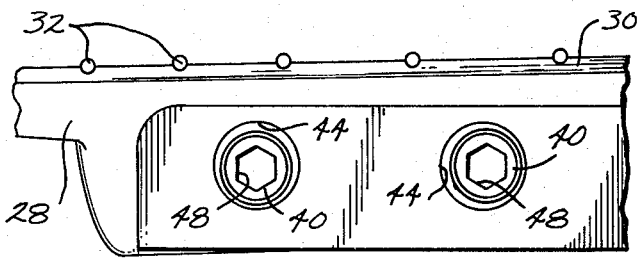
FIG. 3D
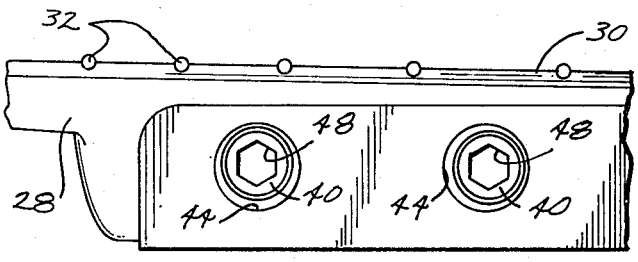

ADJUSTABLE NECK-BODY JOINT FOR GUITAR-LIKE INSTRUMENT

BACKGROUND OF THE INVENTION

1. Field of the Invention

The present invention relates in general to stringed musical instruments and in particular to an adjustable neck-body joint for a guitar-like instrument. In such instruments, the joint between the neck and the body of the instrument must be very firm since any movement along this joint can cause variations in both string height and string length. Unintended decreases in string height can cause spurious contact of the string with the frets and, thus, possible buzzing of the instrument. Small variations in string length can result in serious intonation problems with the instrument.

The neck-body joint also controls the angle or pitch of the neck, and thus the fingerboard, relative to the body of the instrument. If the plane of the fingerboard is virtually the same as that of the guitar top, then a relatively low bridge (i.e., just slightly greater than height than the height of the fingerboard) must be utilized. If the plane of the fingerboard is pitched at a greater angle to the body of the instrument, a higher bridge can be utilized.

It will be appreciated that the optimum pitch of the neck will vary according to the individual preference of the particular musician playing the instrument. Hence, it is desirable to provide a neck-body joint which is adjustable to accommodate these varying preferences. However, such an adjustable neck-body joint must still provide the above-mentioned firmness to permit the instrument to perform reliably.

2. Description Of The Prior Art

To achieve these ends, many adjustable neck-body joint constructions have been proposed in the prior art. For example, U.S. Pat. No. 3,251,257 to Bunker discloses a stringed instrument of the guitar type which provides for the making of adjustments in the spacing of the strings above the fingerboard. A metal bar is contained entirely within the length of the neck of the instrument. The inner end of the metal bar terminates just short of the square cut inner end surface of the wooden neck. The bar is pivotally mounted near its inner end on a cross-shaft which extends horizontally through the base end portion of the neck. At its inner end, the bar rests against an adjusting screw bolt which is threaded upwardly through a metal plate affixed to the body of the guitar. By rotation of this screw bolt, the inner end of the bar may be adjusted upwardly or downwardly, causing the outer end of the bar to move downwardly or upwardly, respectively.

U.S. Pat. No. 2,793,556 to Maccaferri discloses a neck junction for a stringed musical instrument. A saddle structure is provided which is integral with one end wall of the instrument body at the upper side thereof. The neck of the instrument is seated on the saddle structure, extending transversely thereacross and inwardly through the body to a location adjacent the end walls thereof opposite the saddle structure. An adjusting mechanism is operatively connected to the inner end of the neck for selectively applying forces thereto to deflect the neck and saddle structure as a unit, thereby angularly adjusting the neck relative to the top wall of the instrument body. Other stringed instrument constructions are disclosed in U.S. Pat. Nos. 2,795,988 to Maccaferri, 3,911,778 to Martin, and 4,172,405 to Kaman, II.

SUMMARY OF THE INVENTION

The present invention relates to an adjustable neck-body joint for a guitar-like instrument. The instrument includes a main body portion and an elongated neck portion. A pair of threaded apertures are formed transversely in the neck portion near one end thereof. A mounting frame is provided to join the neck and body portions. The mounting frame is adapted to be integrally secured within a recessed portion of the main body of the instrument. When properly secured, the face of the frame is flush with the upper face of the main body. The mounting frame is adapted to receive the threaded end of the neck portion. A pair of apertures are formed in the mounting frame for generally aligning with the threaded apertures when the one end of the neck portion is received by the frame. Threaded fastener means extend through each of the frame apertures into cooperation with the respective threaded apertures on the neck portion, thereby frictionally securing the neck portion to the frame. The threaded fasteners are smaller in diameter than the frame apertures such that the neck portion can be adjusted relative to the frame before the fasteners are tightened.

BRIEF DESCRIPTION OF THE DRAWINGS

FIG. 2 is a sectional plan view of the assembled neck-body joint of FIG. 1;

FIGS. 3A through 3D are elevational views illustrating various adjustments of the neck-body joint of FIG. 2.

DETAILED DESCRIPTION OF THE PREFERRED EMBODIMENT

Figure 1:
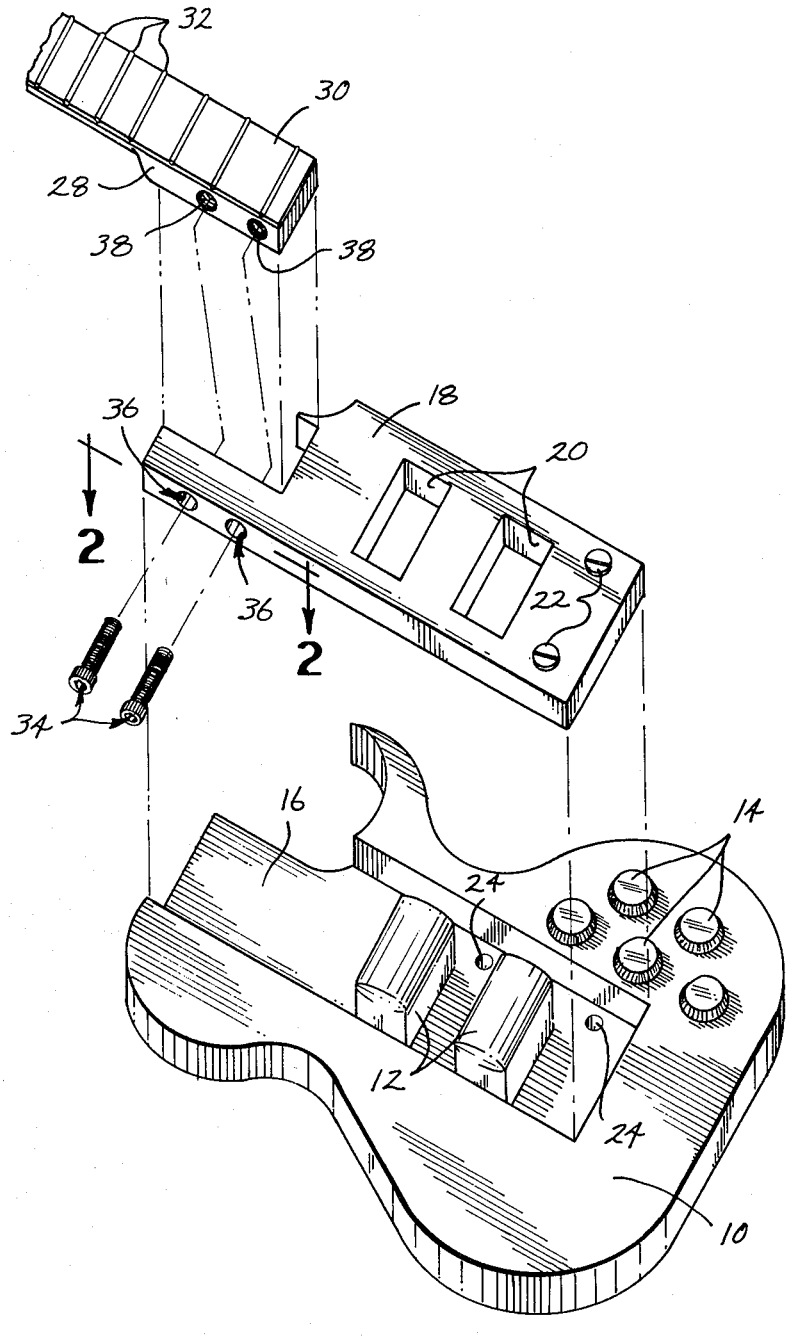
FIG. 1 is an exploded perspective view of a portion of a guitar embodying an adjustable neck-body joint in accordance with the present invention.

Referring now to the drawings, there is illustrated in FIG. 1 a portion of a guitar-like instrument embodying an adjustable neck-body joint in accordance with the present invention. A main body portion 10 of the guitar is typically formed of wood or plastic and is provided on its upper face with a pair of conventional electromagnetic pickups 12 and a plurality of associated electric controls 14. A recessed portion 16 of the guitar body 10 is adapted to receive a correspondingly-shaped neck mounting frame 18 therein. The frame 18 has suitable apertures 20 formed in it to accommodate the electromagnetic pickups 12. The frame 18 can be formed of 6061 aluminum bar stock. The frame 18 also includes a pair of screws 22 for securing a conventional bridge/tailpiece assembly (not shown) to the upper face thereof. The bridge/tailpiece assembly is provided to attach a plurality of guitar strings (not shown) to the guitar body 10 and maintain them in proper alignment above the electromagnetic pickups 12.

The frame 18 is integrally retained in the recessed portion 16 of the guitar body 10 by a plurality of threaded fasteners (not shown). The fasteners extend from the lower face of the guitar body 10 through apertures 24 formed therein (only two are illustrated) into threaded cooperation with respective threaded apertures 26 formed in the lower face of the frame 18 (one is illustrated in FIG. 2). When properly secured in the recessed portion 16 of the guitar body 10, the upper face of the frame 18 is flush with the upper face of the guitar body 10, thereby providing a smooth and comfortable playing surface for the musician.

A neck portion 28 of the guitar is overlaid to its full length along a flat top surface with a fingerboard 30 in which a plurality of conventional metal frets 32 are transversely set. The neck portion 28 of the guitar can be formed of aluminum while the fingerboard 30 can be formed of wood or other conventional fingerboard material. A pair of threaded fasteners 34 extend through apertures 36 formed in the frame 18 into cooperation with respective threaded apertures 38 formed in the neck 28. The fasteners 34 provide a means for securing the neck 28 to the frame 18 and the body 10 of the guitar.

Referring now to FIG. 2, it can be seen that each of the threaded fasteners 34 has an enlarged head portion 40 and a narrower threaded shank portion 42. Also, it can be seen that each of the apertures 36 has a corresponding enlarged recessed portion 44 and a narrower passageway portion 46. The head portion 44 of each fastener 34 can include a hexagonal recession 48, as shown in FIGS. 3A through 3D, for cooperating with an appropriate tightening means, such as an allen wrench. When the threaded shank portion 42 of the fastener 34 is inserted through the passageway 46 into threaded engagement with the aperture 38 formed in the neck 28 and tightened, the head 40 of the fastener 34 will be drawn into frictional engagement with the bottom of the recessed portion 44 of the aperture 36. The depth of the recessed portion 44 of the aperture 36 is greater than the depth of the head portion 40 of the fastener 34 such that the head portion 40 will be completely enclosed within the recessed portion 44 when the fastener 34 is tightened, thereby allowing the frame 18 to be slid into the recessed portion 16 of the guitar 10.

It will be appreciated that the recessed portion 44 and passageway portion 46 of each neck aperture 36 is larger in diameter than the head portion 40 and threaded shank portion 42, respectively, of each threaded fastener 34. Hence, before the threaded fasteners 34 are tightened, a musician can adjust the position of the neck 28 with respect to the frame 18 as desired. FIGS. 3A through 3D illustrate several of the variations of neck pitch and string height available to the musician. FIGS. 3A and 3B illustrate the neck 28 adjusted to a relatively low position. Therefore, the guitar strings will be relatively far apart from the fingerboard 30. FIG. 3A illustrates a relatively low pitch of the neck 28 with respect to the frame 18 while FIG. 3B illustrates a relatively high pitch. FIGS. 3C and 3D illustrate the neck 28 adjusted to a relatively high position with respect to the frame 18. Therefore, the guitar strings will be relatively close to the fingerboard 30. FIG. 3C illustrates a relatively high pitch of the neck 28 with respect to the frame 18 while FIG. 3D illustrates a relatively low pitch.

When the neck 28 has been adjusted to a desired position with respect to the frame 18, the fasteners 34 are tightened to firmly maintain the desired relationship. The frame 18 is then fitted within the recessed portion 16 of the guitar body 10 and firmly secured thereto by the plurality of threaded fasteners.

It will be appreciatd that the neck-body joint of the present invention provides a simple and accurate means for adjusting and maintaining the adjustment of the neck pitch and string height of the instrument. Also, by forming the frame 18 and neck 28 from aluminum, the neck-body joint of the present invention is inherently more stable and less responsive to changeable weather conditions, such as temperature and humidity, than neck-body joints of the prior art. Finally, the construction of the neck-body joint of the present invention permits the instrument to be designed much thinner than previously possible, resulting in reduced weight and increased comfort to the musician. The size of the neck-body joint of the present is no larger than conventional non-adjustable joints. Thus, the upper portions of the fingerboard 30 near the neck-body joint can be reached as easily as if a conventional joint were utilized.

Figure 4:
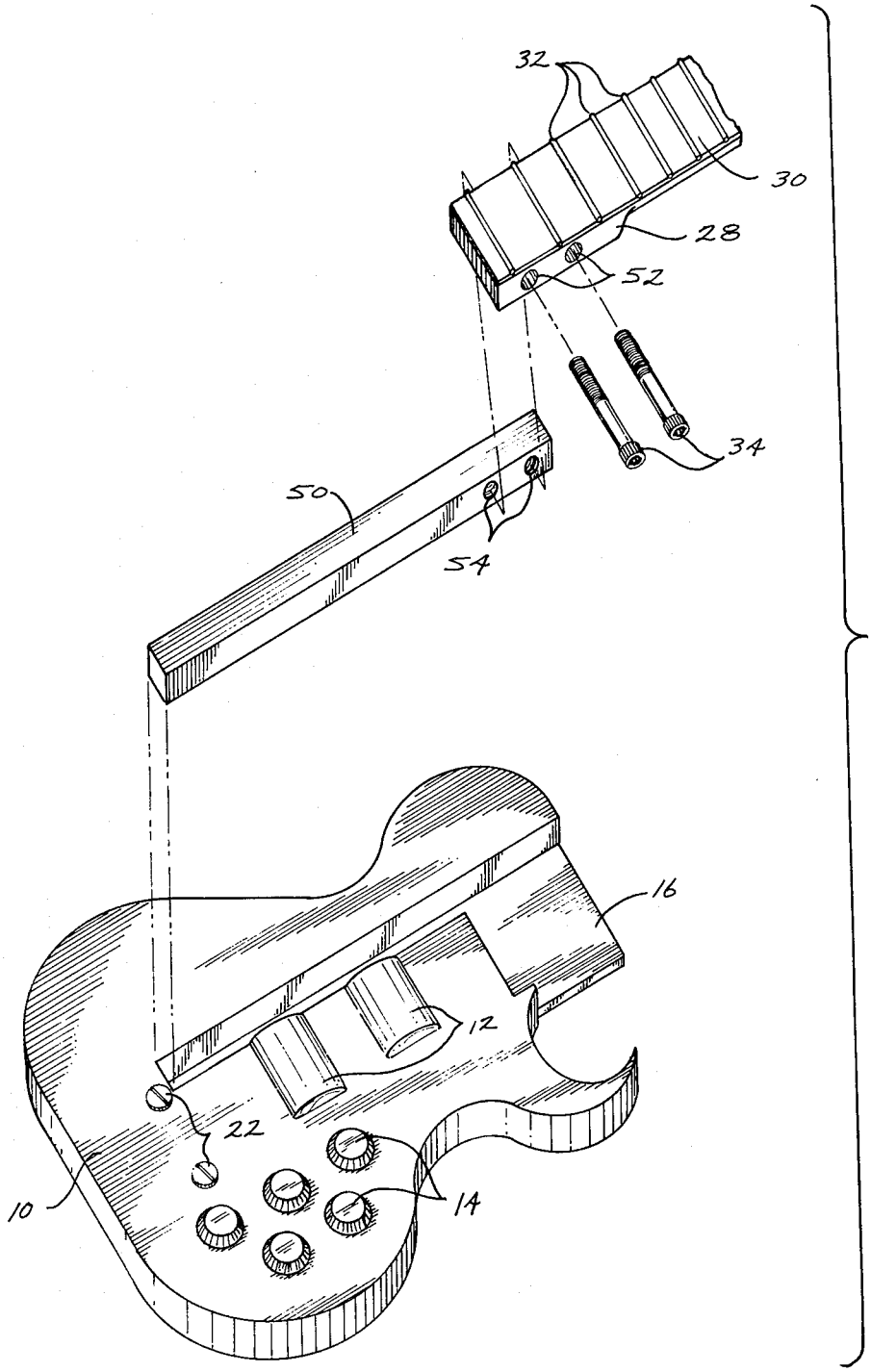
FIG. 4 is an exploded perspective view of a portion of a guitar embodying an alternative neck-body joint in accordance with the present invention.

Referring now to FIG. 4, there is illustrated an exploded perspective view of a portion of a guitar embodying an alternative neck-body joint in accordance with the present invention. The alternative embodiment includes a modified mounting frame portion 50 which is shaped in the form of a rectangular bar. The threaded fasteners 34 extend through respective apertures 52 formed in the one end of the neck 28 into cooperation with respective threaded apertures 54 formed in the frame 50. The neck apertures 52 are similar to the above-described frame apertures 36, each including an enlarged recessed portion 44 and a narrower passageway portion 46. Similarly, the threaded apertures 54 in the frame 50 are similar to the above-described threaded apertures 38 formed in the neck 28. The adjustment of the neck-body joint is accomplished as described above.

It will be appreciated that the alternative embodiment of the present invention illustrated in FIG. 4 permits adjustment of the neck-body joint of the guitar without first requiring removal of the frame 50 from the recessed portion 16 of the main body 10. Instead, the threaded fasteners 34 are exposed and, therefore, can be manipulated by the musician to adjust the pitch of the neck 28 without removing the frame 50 from main body 10. It can be seen that the threaded apertures 54 can be formed directly in the main body portion 10 of the guitar, thereby eliminating the necessity of the frame 50. However, it has been found desirable to include a rigid frame member, such as illustrated above in FIG. 1 or FIG. 4, so as to provide a neck-body joint which is more sturdy and less subject to wear from repeated adjustments.

In accordance with the provisions of the patent statutes, the principle and mode of operation of the present invention have been explained and illustrated in its preferred embodiment. However, it must be understood that the present invention can be practiced otherwise than as specifically explained and illustrated without departing from its spirit or scope.

What is claimed is:

1. A guitar-like instrument comprising, in combination:

a main body portion;

an elongated neck portion having at least two threaded apertures formed transversely therein near one end;

a mounting frame adapted to receive said one end of said neck portion, said frame including respective apertures formed therein for generally aligning with said threaded apertures when said one end of said neck portion is received by said frame;

threaded fastener means extending through each of said frame apertures into cooperation with said threaded apertures for frictionally securing said neck portion to said frame, said fastener means being smaller in diameter than said frame apertures such that said neck portion can be adjusted relative to said frame; and means for integrally securing said frame to said main body portion of the instrument.

2. A guitar-like instrument in accordance with claim 1 wherein said main body portion includes a recessed portion formed therein for retaining said frame therein such that the upper face of said frame is flush with the upper face of said main body portion when said frame is integrally secured to said main body portion.

3. A guitar-like instrument in accordance with claim 1 wherein said frame apertures include an enlarged recessed portion and a narrower passageway portion and said threaded fastener means includes an enlarged head portion and a narrower threaded shank portion.

4. A guitar-like instrument in accordance with claim 1 wherein said means for integrally securing said frame to said main body portion includes a plurality of threaded fasteners extending through apertures formed in said main body portion into cooperation with respective threaded apertures formed in said frame.

5. A guitar-like instrument comprising, in combination:

a main body portion having a recessed portion formed therein;

an elongated neck portion having at least two threaded apertures formed transversely therein near one end;

mounting frame means secured to and extending from said main body portion and adapted to receive said one end of said neck portion, said frame including respective apertures formed therein for generally aligning with said threaded apertures when said one end of said neck portion is received by said frame, each of said frame apertures including an enlarged recessed portion and a narrower passageway portion;

threaded fastener means extending through each of said frame apertures into cooperation with said threaded apertures for frictionally securing said neck portion to said frame, each of said threaded fastener means including an enlarged head portion and a narrower threaded shank portion of smaller diameter than said enlarged recess portion and passageway portion, respectively, of said frame apertures such that said neck portion can be adjusted relative to said frame; and means for integrally securing said frame within said recessed portion of said main body portion of the instrument.

6. A guitar-like instrument comprising, in combination:

a main body portion;

an elongated neck portion having at least two apertures formed transversely therein near one end;

a mounting frame adapted to receive said one end of said neck portion, said frame including respective threaded apertures formed therein for generally aligning with said neck apertures when said one end of said neck portion is received by said frame;

threaded fastener means extending through each of said neck apertures into cooperation with said threaded apertures for frictionally securing said neck portion to said frame, said fastener means being smaller in diameter than said neck apertures such that said neck portion can be adjusted relative to said frame; and means for integrally securing said frame to said main body portion of the instrument.

7. A guitar-like instrument in accordance with claim 6 wherein said main body portion includes a recessed portion formed therein for retaining said frame therein such that the upper face of said frame is flush with the upper face of said main body portion when said frame is integrally secured to said main body portion.

8. A guitar-like instrument in accordance with claim 6 wherein said neck apertures include an enlarged recessed portion and a narrower passageway portion and said threaded fastener means includes an enlarged head portion and a narrower threaded shank portion.

9. A guitar-like instrument in accordance with claim 6 wherein said means for integrally securing said frame to said main body portion includes a plurality of threaded fasteners extending through apertures formed in said main portion into cooperation with respective threaded apertures formed in said frame.

10. A guitar-like instrument comprising, in combination:

an elongated neck portion having at least two apertures formed transversely therein near one end;

a main body portion having a recessed portion formed therein adapted to receive said one end of said neck portion, said main body portion including respective threaded apertures formed therein for generally aligning with said neck apertures when said one end of said neck portion is received by said frame, each of said neck apertures including an enlarged recessed portion and a narrower passageway portion;

threaded fastener means extending through each of said neck apertures into cooperation with said threaded apertures for frictionally securing said neck portion to said main body portion, each of said threaded fastener means including an enlarged head portion and a narrower threaded shank portion of smaller diameter than said enlarged recessed portion and passageway portion, respectively of the neck apertures such that said neck portion can be adjusted relative to said frame; and means for integrally securing said frame within said recessed portion of said main body portion of the instrument.

* * * * *